US011819053B2

(12) United States Patent
Kadiric et al.

(10) Patent No.: US 11,819,053 B2
(45) Date of Patent: Nov. 21, 2023

(54) SMOKING ARTICLE WITH A MOUTH END CAVITY AND VENTILATION

(71) Applicant: PHILIP MORRIS PRODUCTS S.A., Neuchatel (CH)

(72) Inventors: Alen Kadiric, Orpund (CH); Cecilia Lindholm Delaloye, Preverenges (CH)

(73) Assignee: Philip Morris Products S.A., Neuchatel (CH)

( * ) Notice: Subject to any disclaimer, the term of this patent is extended or adjusted under 35 U.S.C. 154(b) by 173 days.

(21) Appl. No.: 17/306,468

(22) Filed: May 3, 2021

(65) Prior Publication Data

US 2021/0274833 A1 Sep. 9, 2021

Related U.S. Application Data

(63) Continuation of application No. 16/521,966, filed on Jul. 25, 2019, now Pat. No. 11,006,663, which is a (Continued)

(30) Foreign Application Priority Data

Mar. 27, 2015 (EP) ..... 15161533

(51) Int. Cl.
*A24D 3/04* (2006.01)
*A24D 3/10* (2006.01)
*A24D 3/17* (2020.01)

(52) U.S. Cl.
CPC ..... *A24D 3/04* (2013.01); *A24D 3/043* (2013.01); *A24D 3/10* (2013.01); *A24D 3/17* (2020.01)

(58) Field of Classification Search
CPC . A24D 1/20; A24D 3/04; A24D 3/043; A24D 3/10; A24D 3/17
See application file for complete search history.

(56) References Cited

U.S. PATENT DOCUMENTS 4,243,053 A * 1/1981 Cartwright ..... A24D 1/10 131/331
4,687,008 A * 8/1987 Houck, Jr. ..... A24D 3/061 131/194

(Continued)

FOREIGN PATENT DOCUMENTS

CN 1454062 12/2005
CN 101790329 7/2010

(Continued)

OTHER PUBLICATIONS

PCT/EP2016/056586 International Search Report and Written Opinion dated Jun. 7, 2016 (10 pages).

(Continued)

*Primary Examiner* — Abdullah A Riyami
*Assistant Examiner* — Thang H Nguyen
(74) *Attorney, Agent, or Firm* — Mueting Raasch Group

(57) ABSTRACT

A smoking article comprises a tobacco rod and a filter connected to the tobacco rod. The filter comprises a first filter segment and a hollow tube segment downstream of the first filter segment. The hollow tube segment defines a cavity at the mouth end of the filter providing an unrestricted flow channel that extends from the downstream end of the first filter segment to the mouth end of the filter. The length of the hollow tube segment is at least about 25 percent of the overall filter length. Further, the smoking article comprises a ventilation zone comprising at least one circumferential row of perforations provided at a location around the first filter segment.

20 Claims, 3 Drawing Sheets

Related U.S. Application Data continuation of application No. 15/552,888, filed as application No. PCT/EP2016/056586 on Mar. 24, 2016, now Pat. No. 10,368,575.

(56) References Cited

U.S. PATENT DOCUMENTS

| | | | | |
|---|---|---|---|---|
| 5,396,910 | A * | 3/1995 | Casey, III | A24D 3/043 131/339 |
| 7,243,659 | B1 * | 7/2007 | Lecoultre | A24D 3/043 131/331 |
| 8,113,217 | B2 | 2/2012 | Grzonka | |
| 8,353,298 | B2 * | 1/2013 | Braunshteyn | A24D 3/045 131/202 |
| 9,848,636 | B2 * | 12/2017 | Brown | A24D 3/045 |
| 10,004,256 | B2 * | 6/2018 | Tritz | A24D 3/061 |
| 10,299,509 | B2 | 5/2019 | Bundren | |
| 2002/0005207 | A1 | 1/2002 | Wrenn | |
| 2006/0090769 | A1 * | 5/2006 | Woodson | A24D 1/20 131/335 |
| 2006/0174901 | A1 * | 8/2006 | Karles | A24D 3/061 131/337 |
| 2007/0012327 | A1 * | 1/2007 | Karles | A24D 3/061 131/202 |
| 2009/0044817 | A1 | 2/2009 | Besso | |
| 2010/0108085 | A1 | 5/2010 | Graham | |
| 2010/0242977 | A1 * | 9/2010 | Tarora | D21H 27/16 131/202 |
| 2011/0083686 | A1 * | 4/2011 | Yang | A24D 3/04 131/328 |
| 2011/0120481 | A1 * | 5/2011 | Besso | A24D 3/048 428/401 |
| 2012/0350169 | | 8/2014 | Camus | |
| 2014/0326259 | A1 * | 11/2014 | Tritz | A24D 3/061 131/276 |
| 2015/0122273 | A1 * | 5/2015 | Mironov | A24C 5/00 131/328 |
| 2015/0208722 | A1 * | 7/2015 | Kadiric | A24D 3/0216 131/337 |
| 2015/0257439 | A1 * | 9/2015 | Tritz | A24D 3/17 131/345 |
| 2015/0359260 | A1 * | 12/2015 | Nappi | A24D 3/045 493/47 |
| 2016/0037824 | A1 * | 2/2016 | Jordil | A24D 3/061 131/335 |
| 2016/0302477 | A1 * | 10/2016 | Besso | A24D 3/045 |
| 2016/0302478 | A1 * | 10/2016 | Lavanant | A24D 3/066 |

FOREIGN PATENT DOCUMENTS

| | | |
|---|---|---|
| CN | 101896082 | 11/2010 |
| CN | 103476278 | 12/2013 |
| CN | 103917115 | 7/2014 |
| CN | 103889257 | 6/2015 |
| EA | 14830 B1 | 2/2011 |
| JP | 2005/273073 | 10/2005 |
| JP | 2005/535323 | 11/2005 |
| JP | 3190304 | 5/2014 |
| KR | 10-2009-0037866 | 1/2008 |
| KR | 10-2014-0088590 | 7/2014 |
| WO | WO 00/00047 | 1/2000 |
| WO | WO 2009/144499 | 12/2009 |
| WO | WO 2012/076649 | 6/2012 |
| WO | WO 2013/068337 | 5/2013 |
| WO | WO 2014/023557 | 2/2014 |
| WO | WO 2014/102094 | 7/2014 |
| WO | WO 2014/158051 | 10/2014 |

OTHER PUBLICATIONS

Office Action issued in China for Application No. 201680015391.1 dated Jul. 20, 2020 (15 pages). English translation included.
Office Action issued in China for Application No. 201680015391.1 dated Oct. 31, 2019 (17 pages). English translation included.
Office Action issued in Russia for Application No. 2017134690 dated Sep. 26, 2019 (19 pages). English translation included.
Office Action issued in Korea for Application No. 10-2017-7025316 dated Apr. 6, 2023 (4 pages).
Office Action issued in Korea for Application No. 10-2021-7016283 dated Jul. 10, 2023 (9 pages). English translation included.

* cited by examiner

SMOKING ARTICLE WITH A MOUTH END CAVITY AND VENTILATION

This application is a continuation of U.S. application Ser. No. 16/521,966 filed Jul. 25, 2019 (which will issue as U.S. Pat. No. 11,006,663), which is a continuation application of U.S. application Ser. No. 15/552,888 filed Aug. 23, 2017 (which issued as U.S. Pat. No. 10,368,575 B2), and which is a U.S. National Stage Application of International Application No. PCT/EP2016/056586, filed Mar. 24, 2016, which was published in English on Oct. 6, 2016, as International Publication No. WO 2016/156223 A1. International Application No. PCT/EP2016/056586 claims priority to European Application No. 15161533.3 filed Mar. 27, 2015. A certified copy of European Application No. 15161533.3 filed Mar. 27, 2015, was provided in, and is available in, U.S. patent application Ser. No. 15/552,888, for which certified copy is available in PAIR.

The present invention relates to a smoking article having a mouth end cavity defined by a hollow tube segment.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper, normally formed of an opaque paper material that circumscribes the entire length of the filter and an adjacent portion of the wrapped tobacco rod. Smoking articles having a cavity at the mouth end of their filter section have also been proposed.

A number of smoking articles in which tobacco is heated rather than combusted have also been proposed in the art. In heated smoking articles, an aerosol is generated by heating an aerosol generating substrate, such as tobacco. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco material, tobacco extract or other nicotine source, without combustion and in some cases without heating, for example through a chemical reaction.

As noted above, in some cases, a smoking article may have a cavity at the mouth end of the filter. Such mouth end cavities are typically formed by extending the plug wrap, the tipping paper, or both the plug wrap and the tipping paper of the filter beyond the most downstream segment of filtration material. However, typical plug wraps may not provide sufficient strength when the length of the mouth end cavity is increased. There is therefore a risk of deformation of such mouth end cavities as the length of the cavity is increased.

It would therefore be desirable to provide a filtered smoking article having a mouth end cavity of increased length, which is less likely to be vulnerable to deformation. At the same time, it would be desirable to provide such a filtered smoking article that could be manufactured using standard apparatus and techniques, without the requirement for significant changes to existing machines and methods. Furthermore, it would be desirable to provide such a filtered smoking article, without undesirably altering the general smoking experience for a consumer.

According to a first aspect of the present invention, there is provided a smoking article comprising a tobacco rod and a filter connected to the tobacco rod. The filter comprises a hollow mouth end portion and a filtration portion upstream of the hollow mouth end portion, the filtration portion comprising one or more filter segments. The hollow mouth end portion defines a cavity at the mouth end of the filter providing an unrestricted flow channel that extends from the downstream end of the filtration portion to the mouth end of the filter. The length of the hollow mouth end portion is at least about 25 percent of the overall filter length. Further, the smoking article comprises a ventilation zone comprising at least one circumferential row of perforations provided at a location around the filtration portion.

As used herein, the terms "upstream" and "downstream" are used to describe the relative positions of elements, or portions of elements, of the smoking article in relation to the direction in which a consumer draws on the smoking article during use thereof. Smoking articles as described herein comprise a downstream end and an opposed upstream end. In use, a consumer draws on the downstream end of the smoking article. The downstream end, which is also described as the mouth end, is downstream of the upstream end, which may also be described as the distal end.

The expression "unrestricted flow" is used throughout this specification to indicate that the hollow tube segment internally defines a channel having a substantially constant cross-sectional area for the smoke and air to flow through. Further, the expression "unrestricted flow channel" is used throughout this specification to indicate that the hollow tube segment does not contain any object which may cause a local restriction of the flow of the smoke and air. In other words, the hollow tube segment is empty. Thus, the cross-sectional area available for the smoke and air to flow through is substantially constant along the whole length of the hollow tube segment and flow of smoke and air through the hollow tube segment is substantially unobstructed.

The expression "overall filter length" is used throughout this specification to refer to the sum of the length of the various components forming the filter. Thus, the expression "overall filter length" should be construed as referring at least to the sum of the length of the hollow tube segment and the length of the first filter segment. Similarly, if the smoking article comprises more than one filter segments upstream of the hollow tube segment, the expression "overall filter length" should be construed as referring to the sum of the length of the hollow tube segment and the length of each of the other filter segments in the smoking article.

The hollow mouth end portion may be formed by a plug wrap circumscribing the one or more segments of the filtration portion, and extending downstream of the filtration portion to define the cavity at the mouth end. In such embodiments, the plug wrap preferably has a basis weight of at least about 70 grams per square metre, preferably at least about 80 grams per square metre. The plug wrap may have a basis weight of between about 120 grams per square metre and about 70 grams per square metre, preferably of between about 80 grams per square metre and about 100 grams per square metre. Most preferably, the plug wrap has a basis weight of about 80 grams per square metre. This can help to enhance the structural rigidity of the hollow mouth end portion of the filter.

Alternatively, in some preferred embodiments, the hollow mouth end portion is formed by a hollow tube segment that is disposed at the mouth end of the filter.

Accordingly, in some embodiments of the present invention, there is provided a smoking article comprising a tobacco rod and a filter connected to the tobacco rod. The filter comprises a filtration portion comprising one or more filter segments, and a hollow tube segment disposed downstream of the filtration portion. The hollow tube segment defines a cavity at the mouth end of the filter providing an unrestricted flow channel that extends from the downstream end of the filtration portion to the mouth end of the filter. The length of the hollow tube segment is at least about 25 percent of the overall filter length. Further, the smoking article comprises a ventilation zone comprising at least one circumferential row of perforations provided at a location around the filtration portion.

By providing a hollow tube segment in the filter to define a cavity at the mouth end, and arranging for the length of the hollow tube segment to be at least about 25 percent of the overall filter length, a relatively long mouth end cavity can be formed in the filter, without greatly increasing the risk of the mouth end cavity being vulnerable to deformation. This is because the hollow tube segment may provide an increased strength or rigidity at the mouth end of the filter.

Furthermore, by providing at least one circumferential row of perforations provided at a location around the filtration portion, the ventilated introduction of air into the filter will not affect the structure of the mouth end cavity. Mainstream smoke can be diluted upstream of the mouth end cavity and allowed to mix further with air as it passes through the relatively long mouth end cavity.

According to the present invention, the inclusion of a filter comprising an unrestricted hollow tube segment having the features specified above advantageously allows for a filtered smoking article having a mouth end cavity of increased length, which is less likely to be vulnerable to deformation.

Preferably, the length of the hollow tube segment is less than about 50 percent of the overall filter length. Thus, the length of the filtration portion upstream of the hollow tube segment shall account for at least about 50 percent of the overall filter length. The unrestricted, hollow tube segment does not substantially contribute to increasing the resistance to draw (RTD) of the smoking article. At most, the unrestricted, hollow tube segment contributes only marginally to increasing the RTD of the smoking article. In practice, the unrestricted, hollow tube segment may be adapted to generate a RTD in the range of approximately 1 mm $H_2O$ (about 10 Pa) and approximately 20 mm $H_2O$ (about 200 Pa). Preferably, the unrestricted, hollow tube segment is adapted to generate a RTD between approximately 2 mm $H_2O$ (about 20 Pa) and approximately 10 mm $H_2O$ (about 100 Pa). Where the filter segment or segments upstream of the unrestricted, hollow tube segment account for at least about 50 percent of the overall filter length, it is advantageously possible, by selecting filtration material or materials of appropriate density and characteristics, to adjust the overall RTD of the smoking article to satisfactory levels. In some preferred embodiments, the filter segment or segments upstream of the unrestricted, hollow tube segment account for at least about 60 percent of the overall filter length.

Preferably, the length of the hollow tube segment is less than about 30 mm. More preferably, the length of the hollow tube segment is less than about 20 mm. Still more preferably, the length of the hollow tube segment is less than about 15 mm. In addition, or as an alternative, the length of the hollow tube segment is at least about 8 mm. Preferably, the length of the hollow tube segment is at least about 10 mm. In some preferred embodiments, the length of the hollow tube segment is from about 8 mm to about 30 mm, more preferably from about 10 mm to about 20 mm, even more preferably from about 10 to about 15 mm, most preferably about 10 mm. This not only provides a mouth end cavity and an unrestricted flow channel of an appropriate size, but also ensures sufficient overlap between the hollow tube segment and any wrapper which may circumscribe the hollow tube segment to maintain it in axial alignment with the filter segment or with the tobacco rod or with both. Such wrappers include plug wraps and tipping paper bands.

In preferred embodiments, the filtration portion comprises a first filter segment. Preferably, the length of the first filter segment is at least about 8 mm. In certain preferred embodiments, the length of the first filter segment is at least about 10 mm. Alternatively, or in addition, the length of the first filter segment is less than about 14 mm. In preferred embodiments, the length of the first filter segment is between about 8 mm and about 14 mm, more preferably between about 10 mm and about 14 mm. In certain preferred embodiments, the length of the first filter segment is about 12 mm.

In certain embodiments according to the invention, the length of the hollow tube segment is within 5 mm of the length of the first filter segment. In more preferred embodiments, the length of the hollow tube segment is within 2 mm of the length of the first filter segment. Alternatively, or in addition, in certain embodiments according to the invention, the length of the hollow tube segment is less than the length of the first filter segment.

In certain embodiments according to the invention, the length of the first filter segment is at least about 10 percent of the overall filter length. Preferably the length of the first filter segment is at least about 20 percent of the overall filter length. More preferably, the length of the first filter segment is at least about 30 percent of the overall filter length. Alternatively, or in addition, the length of the first filter segment may be less than about 80 percent of the overall filter length. Preferably, the length of the first filter segment is less than about 60 percent of the overall filter length. More preferably, the length of the first filter segment is less than about 40 percent of the overall filter length.

In certain preferred embodiments, the length of the first filter segment is between about 10 percent and about 80 percent of the overall filter length. In more preferred embodiments, the length of the first filter segment is between about 20 percent and about 60 percent of the overall filter length. In still more preferred embodiments, the length of the first filter segment is between about 30 percent and about 40 percent of the overall filter length.

In certain preferred embodiments of the invention, the combined length of the hollow tube segment and the first filter segment is at least about 35 percent of the overall filter length. Preferably, the combined length of the hollow tube segment and the first filter segment is at least about 50 percent of the overall filter length. More preferably, the combined length of the hollow tube segment and the first filter segment is at least about 70 percent of the overall filter length.

Preferably, the at least one circumferential row of perforations is located at least about 5 mm upstream from the downstream end of the first filter segment. More preferably, the at least one circumferential row of perforations is located at least about 5 mm upstream from the downstream end of the first filter segment. In more preferred embodiments, the at least one circumferential row of perforations is located at least about 8 mm upstream from the downstream end of the first filter segment. This advantageously makes it less likely for the consumer to obstruct the ventilation zone when holding the smoking article with his or her lips or fingers.

In addition, or as an alternative, the at least one circumferential row of perforations is preferably located less than about 12 mm upstream from the downstream end of the first filter segment. More preferably, the at least one circumferential row of perforations is preferably located less than about 10 mm upstream from the downstream end of the first filter segment. This can ensure the at least one circumferential row of perforations is not positioned too close to the tobacco rod.

In some preferred embodiments, the at least one circumferential row of perforations is preferably located from about 1 mm to about 12 mm upstream from the downstream end of the first filter segment. In some more preferred embodiments, the at least one circumferential row of perforations is preferably located from about 3 mm to about 10 mm upstream from the downstream end of the first filter segment. In further preferred embodiments, the at least one circumferential row of perforations is preferably located from about 8 mm to about 10 mm upstream of the downstream end of the first filter segment. Alternatively, or in addition, according to the invention, the at least one circumferential row of perforations is disposed a distance from the mouth end of the filter that is at least about 50 percent of the overall filter length. Preferably, the at least one circumferential row of perforations is disposed a distance from the mouth end of the filter that is at least about 70 percent of the overall filter length.

In some preferred embodiments, the ventilation zone comprises two circumferential rows of perforations provided at a location around the first filter segment. For example, the perforations may be formed online during manufacture of the smoking article. Preferably, each circumferential row of perforations comprises from 8 to 30 perforations.

The tobacco rod typically comprises a charge of tobacco cut filler circumscribed by a paper wrapper.

The hollow tube segment and the one or more filter segments of the filtration portion are preferably circumscribed by a band of plug wrap, referred to hereafter as a combining plug wrap. Preferably, the combining plug wrap is impermeable.

Preferably, the combining plug wrap has a basis weight of less than about 120 grams per square metre, preferably less than about 100 grams per square metre, more preferably less than about 90 grams per square metre. In addition, or as an alternative, the combining plug wrap preferably has a basis weight of at least about 70 grams per square metre, preferably at least about 80 grams per square metre. The combining plug wrap may have a basis weight of between about 120 grams per square metre and about 70 grams per square metre, preferably of between about 80 grams per square metre and about 100 grams per square metre. Most preferably, the plug wrap has a basis weight of about 80 grams per square metre. By arranging for the combining plug wrap to have such a relatively high basis weight, the segments of the filter that are upstream of the hollow tube segment may exhibit a firmness that is comparable to the firmness of the filter at the hollow tube segment. This can advantageously give a consumer the perception that the filter has a generally uniform firmness along its length, and therefore make the presence of the hollow tube segment is less noticeable.

Preferably, the combining plug wrap has a thickness of at least about 80 micrometres, more preferably a thickness of at least about 100 micrometres. Preferably, combining plug wrap has a thickness of less than about 180 micrometres, more preferably a thickness of less than about 140 micrometres. By arranging for the combining plug wrap to have such a relatively high thickness, the segments of the filter that are upstream of the hollow tube segment may exhibit a firmness that is comparable to the firmness of the filter at the hollow tube segment. This can advantageously give a consumer the perception that the filter has a generally uniform firmness along its length, and therefore make the presence of the hollow tube segment is less noticeable.

The combining plug wrap may be affixed to the hollow tube segment and one or more filter segments of the filtration portion using, for example, an adhesive. Where the filter comprises a substantially air impermeable combining plug wrap, the ventilation zone preferably comprises at least one circumferential row of perforations provided through a portion of the combining plug wrap. By way of example, the perforations through the plug wrap may be formed online during manufacture of the smoking article. Preferably, the circumferential row or rows of perforations provided through a portion of the combining plug wrap are in substantial alignment with a portion of the first filter segment.

The filter comprising the combining plug wrap is preferably attached to the tobacco rod by a band of substantially impermeable tipping paper. The tipping wrapper may comprise paper having a basis weight of less than about 70 grams per square metre, preferably less than about 50 grams per square metre. The tipping wrapper preferably has a basis weight of more than about 20 grams per square metre.

The band of tipping paper may extend over the whole length of the filter and over a portion of the tobacco rod. Thus, the band of tipping paper may overlap ventilation perforations provided at a location around the first filter segment. In such embodiments, the ventilation perforations preferable extend through the band of tipping paper.

As mentioned above, the one or more filter segments of the filtration portion may comprise additional filter segments in combination with the first filter segment. For example, in one embodiment, the smoking article further comprises a rod end segment of filtration material between the first filter segment and the tobacco rod. The filter may include one or more additional filter segments between the first end segment and the rod end segment. However, in preferred embodiments, the rod end segment of filtration material abuts the first filter section. In more preferred embodiments, the rod end segment of filtration material abuts both the first filter segment and the tobacco rod.

Preferably the length of the rod end segment of filtration material is within about 5 mm of the length of the first filter segment. More preferably, the length of the rod end segment of filtration material is within about 1 mm of the length of the first filter segment. In some particularly preferred embodiments, the length of the rod end segment of filtration material is substantially the same as the length of the first filter segment.

In certain preferred embodiments, the length of the rod end segment of filtration material is at least about 20 percent of the overall filter length. More preferably, the length of the rod end segment of filtration material is at least about 30 percent of the overall filter length.

Alternatively, or in addition, the length of the rod end segment of filtration material is less than about 80 percent of the overall filter length. Preferably, the length of the rod end segment of filtration material is less than about 50 percent of the overall filter length.

In certain preferred embodiments, the length of the rod end segment of filtration material is between about 20 percent and about 80 percent of the overall filter length. In more preferred embodiments, the length of the rod end segment of filtration material is between about 30 percent and about 50 percent of the overall filter length.

The filtration material within each filter segment of the smoking article is preferably a plug of fibrous filtration material, such as cellulose acetate tow or paper. A filter plasticiser may be applied to the fibrous filtration material in a conventional manner, by spraying it onto the separated fibres, preferably before applying any additional material to the filtration material. Alternatively, or in addition, smoking articles in accordance with the present invention may include one or more segments containing one or more additives. These additives may include, but are not limited to, flavorants and carbon particles.

Preferably, the rod end segment comprises carbon particles. Preferably, the carbon is activated carbon. In preferred embodiments, the density of carbon particles in the rod end segment is at least about 1 milligram of carbon per millimetre of filtration material. More preferably, the density of carbon particles in the rod end segment is at least about 5 milligrams of carbon per millimetre of filtration material. The density of carbon particles in the rod end segment may not be greater than about 15 milligrams of carbon per millimetre of filtration material, preferably not greater than 10 milligrams of carbon per millimetre of filtration material.

The density of carbon particles in the rod end segment may be between about 1 milligram of carbon per millimetre of filtration material and about 15 milligrams of carbon per millimetre of filtration material, preferably between about 5 milligrams of carbon per millimetre of filtration material and about 10 milligrams of carbon per millimetre of filtration material.

The hollow tube segment may be formed from any suitable material. For example, the hollow tube segment may be formed from an annular shaped segment of filtration material, such as cellulose acetate, having a hollow core extending from the upstream end of the annular shaped segment to the downstream end of the annular shaped segment. Such segments may be referred to as a hollow acetate tube. Preferably, the filtration material of the annular shaped segment is of high particulate efficiency. Preferably, the filtration material of the annular shaped segment comprises fibres of between approximately 1.5 denier per filament (dpf) and approximately 5 dpf, more preferably between approximately 1.5 denier per filament (dpf) and approximately 3 dpf. In a preferred embodiment, the filtration material of the annular shaped segment comprises fibres of approximately 3.3 dpf. Preferably, the filtration material of the annular shaped segment comprises fibres of between approximately 30000 total denier (td) and approximately 50000 td, more preferably between 35000 total denier (td) and approximately 50000 td. In a preferred embodiment, the filtration material of the annular shaped segment comprises fibres of approximately 44000 td. Preferably, the hollow tube segment comprises one or more plasticisers. Suitable plasticisers include triacetin, and triethylenglycol di-acetate. Preferably, the plasticiser is present in the annular shaped segment in an amount of between about 5 and about 15 percentage weight, more preferably between about 8 and about 12 percentage weight. This can help the hollow tube segment to maintain its structural rigidity in the filter, which is particularly important since the length of the hollow tube segment is at least about 25 percent of the overall filter length.

In some other preferred embodiments, the hollow tube segment is preferably formed from a paper material. More preferably, the hollow tube segment is formed from a plurality of overlapping paper layers, such as a plurality of parallel wound paper layers or a plurality of spirally wound paper layers. Forming the hollow tube segment from a plurality of overlapping paper layers can help to improve resistance to collapse or deformation.

Preferably each hollow tube segment comprises at least two paper layers. Alternatively, or additionally, each hollow tube segment preferably comprises fewer than eleven paper layers.

Preferably, at least one of the paper layers is made from a paper with a basis weight of at least about 100 grams per square metre.

Preferably, the wall thickness of the hollow tube segment is at least about 100 micrometres. More preferably, the wall thickness of the hollow tube segment is at least about 200 micrometres. Alternatively, or in addition, the wall thickness of the hollow tube segment is less than about 300 micrometres. Preferably, the wall thickness of the hollow tube segment is less than about 270 micrometres. In some preferred embodiments, the wall thickness of the hollow tube segment is from about 100 micrometres to about 300 micrometres, preferably from 200 micrometres to 270 micrometres.

An exemplary method for forming a tube segment from a plurality of wound paper layers comprises wrapping a plurality of substantially continuous paper strips in an overlapping manner about a cylindrical mandrel. The strips are wrapped in a parallel manner or a spiral manner so as to form a substantially continuous tube on the mandrel. The formed tube may be turned about the mandrel, for example using a rubber belt, so that the paper layers are continually drawn and wrapped around the mandrel. The formed tube can then be cut into the required lengths downstream of the mandrel.

One factor that may restrict the ability of the hollow tube segment to retain its ovality during smoking of the smoking article is absorption of moisture into the tube segment during smoking. Therefore, to inhibit the transfer of moisture from one paper layer to the next during smoking of the smoking article, adjacent paper layers of each tubular member are preferably adhered together by an intermediate layer of adhesive, which provides a barrier to the transfer of moisture between layers.

In any of the embodiments described above, the resistance of the hollow tube segment to collapse or deformation may be such that the difference between the ovality of the tube segment after 50 percent deformation of the filter and the ovality of the tube segment prior to deformation is less than about 25 percent, preferably less than about 20 percent. For example, where the ovality of the tube segment prior to deformation is 5 percent, the ovality of the tube segment after a 50 percent deformation of the filter is preferably less than 30 percent, more preferably less than 25 percent. The particular test procedure for conducting deformations of the filter in accordance with present invention is described in detail below.

The term "ovality" as used herein means the degree of deviation from a perfect circle. Ovality is expressed as a percentage and the mathematical definition is given below, with reference to FIG. 4.

$$\text{ovality (percent)}=2(a-b)/a+b\times 100 \text{ percent}$$

To determine the ovality of a segment of a smoking article (such as a hollow tube segment) in accordance with the present invention, the mouth end is viewed along the longitudinal direction of the smoking article. For example, the smoking article can be positioned on its mouth end on a transparent stage so that an image of the mouth end of the article is recorded by a suitable imaging device located below the stage. Dimension "b" is taken to be the smallest external diameter of the segment at its downstream end and dimension "a" is taken to be the largest external diameter of the segment at its downstream end. The process is repeated for a total of ten smoking articles having the same design and the number average of the ten ovality measurements is recorded as the ovality for that design of smoking article.

Since smoking article filters are generally circular in cross section, the ovality of the hollow tube segment after a 50 percent deformation is preferably less than about 25 percent, more preferably less than about 20 percent. In this case, the mouth end cavity of smoking articles in accordance with the present invention will retain or resume a generally circular cross section, even after a 50 percent deformation of the filter. Alternatively, or in addition, the ovality of the tube segment after a 67 percent deformation of the filter is preferably less than about 35 percent, more preferably less than about 30 percent.

In some embodiments, the ovality of the hollow tube segment after a 50 percent deformation of the filter performed after the smoking article has been subjected to a smoking test is preferably less than about 35 percent, more preferably less than about 30 percent. Alternatively, or in addition, the ovality of the tube segment after a 67 percent deformation of the filter performed after the smoking article has been subjected to a smoking test is preferably less than about 45 percent, more preferably less than about 40 percent. This advantageously provides consistency in the ovality of the mouth end cavity during smoking of the smoking article.

The smoking test used for testing smoking articles in accordance with the present invention is described in detail below. Where it is necessary to measure the ovality after deformation tests performed both before and after smoking, two samples of smoking articles having the same design should be used. That is, a non-deformed un-smoked smoking article should be used for the pre-smoking deformation test, and non-deformed articles having the same design are subjected to the smoking test and used for the post-smoking deformation test.

As discussed above, one factor that may restrict the ability of the hollow tube segment to retain its ovality during smoking of the smoking article is absorption of moisture into the tube segment. Therefore, the hollow tube segment may comprise a coating layer on an inner surface thereof, which can inhibit absorption of moisture into the hollow tube segment. In those embodiments in which the hollow tube segment is formed from a plurality of paper layers, a coating layer may additionally or alternatively be provided between some or all of the adjacent paper layers. Suitable coating materials include, but are not limited to, waxes, polymeric materials and combinations thereof. Particularly suitable waxes include vegetable waxes, and other particularly suitable materials are ethyl-cellulose and nitrocellulose.

To increase the resistance of the hollow tube segment to crushing, the filter preferably has an un-smoked compressive strength of at least about 20 Newtons at 50 percent compression. Alternatively, or in addition, the un-smoked compressive strength of the filter at 50 percent compression is preferably less than about 50 Newtons. The term "compressive strength" is a measure of the force required to provide a particular compression of the filter section of the smoking article. Compressive strength is measured using the compressive strength test described in detail below, where the compressive strength of a given smoking article design is the number average of the compressive strength measurements for a sample of ten smoking articles having the same design.

In some embodiments, it may be desirable to provide the filter with means for releasing a flavourant or other additive on demand, usually via manual release by the consumer immediately prior to smoking the article. Therefore, the filter may comprise at least one filter segment including a flavourant containing material, such as, for example, one or more breakable capsules comprising an outer shell and an inner core containing an additive. Preferably the at least one filter segment comprises one or more breakable capsules dispersed within a fibrous filtration material. The at least one filter segment may be the first filter segment, or an additional filter segment which may be incorporated into the filter, or a combination thereof.

In embodiments comprising a flavourant containing material, the at least one flavour containing filter segment is preferably circumscribed by a plug wrap that is substantially impermeable to the flavourant additive. This advantageously inhibits transfer of the additive through the plug wrap to the outside of the smoking article, where it may undesirably come into contact with the consumer's fingers and may tarnish the appearance of the smoking article.

Test Procedures

Deformation and Compressive Strength Test

The smoking article to be tested is positioned between a flat surface and a circular plate opposed to the flat surface, the circular plate having a diameter of 10 mm. The circular plate closest to the mouth end of the smoking article is positioned 8 mm from the mouth end. The filter is then compressed by moving the circular plate towards the flat surface at a constant speed of 100 mm per second. The force applied by the circular plate is increased until the desired deformation of the portion of the smoking article between the circular plate and the flat surface is achieved. For example, to achieve a 50 percent deformation, the compressed portion of the smoking article is compressed to a diameter of 50 percent of the diameter of that portion prior to compression. Similarly, to achieve a 67 percent deformation, the smoking article is compressed until the compressed portion is reduced to a diameter of 33 percent of the diameter of that portion prior to compression. The diameter is measured in the direction of compression, which is the direction extending between the flat surface and the circular plate. Once the desired compression has been achieved, the force required to provide that compression is noted as the compressive strength of the filter. The circular plate is then retracted so that the compressive force is removed. The smoking article is left for 30 seconds to expand before any further tests or measurements are performed.

Smoking Test

To simulate the smoking of a smoking article, the smoking article is subjected to a standard smoking test under ISO conditions (35 ml puffs lasting 2 seconds each, every 60 seconds). In the ISO test method, the smoking article is smoked with the ventilation zone fully uncovered.

Although preferred features of the present invention have been primarily described above by way of reference to embodiments in which the hollow mouth end portion is formed by a hollow tube segment that is disposed at the mouth end of the filter, the skilled person will appreciate that, where applicable, such preferred features may be used in embodiments in which the hollow mouth end portion is formed by a plug wrap. For example, where preferred dimensions of the hollow tube segment have been described above, the skilled person will appreciate that these dimensions may be preferable for embodiments in which the hollow mouth end portion is formed by a plug wrap.

The invention will now be further described, by way of example only, with reference to the accompanying drawings in which.

Figure 1:
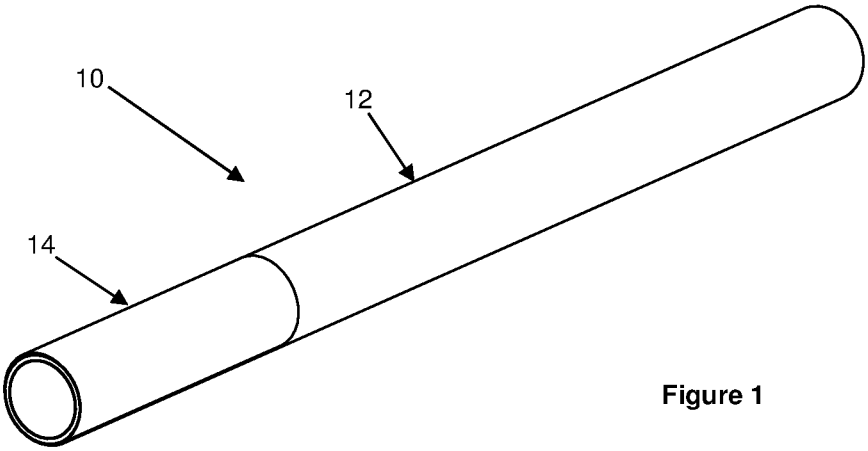
FIG. 1 shows a smoking article in accordance with the present invention.
Figure 2:
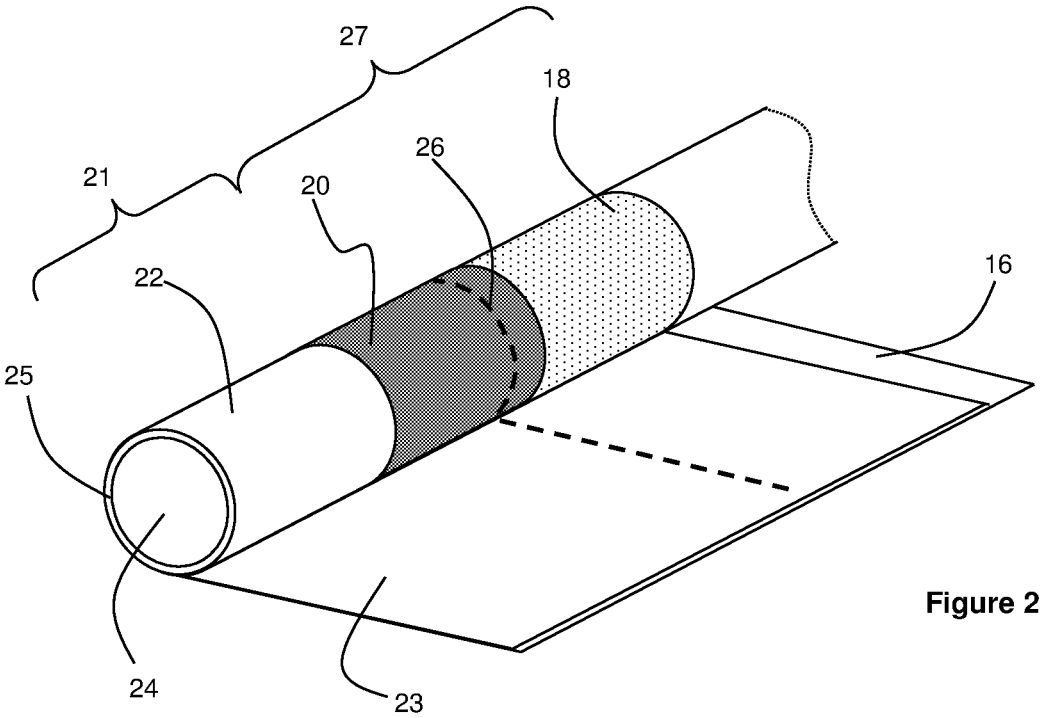
FIG. 2 shows the mouth end of the smoking article of FIG. 1 with the filter unwrapped.

FIGS. 1 and 2 illustrate a smoking article 10 in accordance with the present invention. The smoking article 10 comprises a wrapped rod 12 of tobacco cut filler which is attached at one end to an axially aligned filter 14. A band of tipping paper 16 circumscribes the filter 14 and a portion of the wrapped rod 12 of tobacco to join together the two portions of the smoking article 10.

As shown in FIG. 2, the filter 14 comprises a hollow mouth end portion 21 formed by a hollow tube segment 22 and a filtration portion 27 comprising a first filter segment 20, which may or may not contain flavour, and a rod end filter segment 18. The upstream end of the hollow tube segment 22 abuts the downstream end of the first filter segment 20. The upstream end of the first filter segment 20 abuts the downstream end of the rod end filter segment 18. The upstream end of the rod end filter segment 18 abuts the tobacco rod 12. The hollow tube segment is 10 mm long. The first filter segment is 12 mm long. The rod end filter segment is 12 mm long. The overall filter length is 34 mm.

Figure 4:
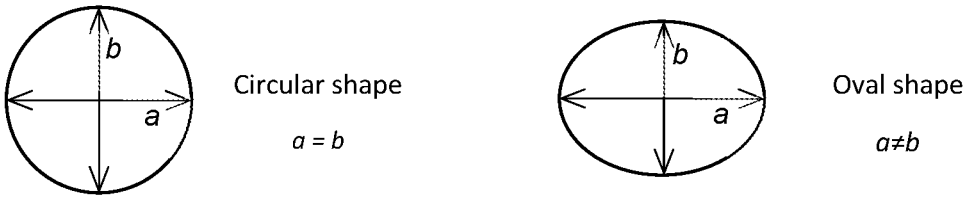
FIG. 4 is a schematic drawing of a circle and an oval illustrating dimensions.

The hollow tube segment 22 and the filter segments 20 and 18 are circumscribed by a band of combining plug wrap 23 which connects the three segments to form the filter 14. One or more of the segments 18, 20, 22 may additionally be wrapped in an individual plug wrap. FIG. 4 is a schematic drawing of a circle and an oval illustrating dimensions. The first filter segment 20 and the rod end filter 18 segment are formed of a suitable filtration material, such as cellulose acetate tow. Furthermore, the first filter segment 20 may comprise a suitable flavourant, which may be provided in the form of one or more breakable capsules contained within the first filter segment 20. In this case, the one or more breakable capsules are ruptured by the consumer when desired by squeezing the first filter segment 20 between the consumer's fingers. The rod end filter segment 18 contains an adsorbent material, such as a carbon-based adsorbent material.

The hollow tube segment 22 defines a mouth end cavity 24 in the filter 14 and provides an unrestricted flow channel 25 which extends between the downstream end of the first filter segment 20 and the mouth end of the filter 14. In more detail, the hollow tube segment 22 internally defines a channel having a substantially constant cross-sectional area for the smoke and air to flow through. Further, the hollow tube segment 22 does not contain any object adapted to cause a local restriction of the flow of the smoke and air. Thus, the cross-sectional area available for the smoke and air to flow through is substantially constant along the whole length of the hollow tube segment 22 and flow of smoke and air through the hollow tube segment 22 is unobstructed.

In the embodiment of FIGS. 1 and 2, the length of the hollow tube segment 22 is about 30 percent of the overall filter length. Further, the hollow tube segment 22 may have a wall thickness from about 100 micrometres to about 300 micrometres.

The hollow tube segment 22 may be formed of a plurality of spirally wound paper layers which can further improve the resistance to deformation of the mouth end cavity 24, for example during smoking or during rupture of the one or more breakable capsules when present in the first filter segment 20. Figure 4 is a schematic drawing of a circle and an oval illustrating dimensions. The ovality of the hollow tube segment after a 50 percent deformation of the filter 14 may be less than 25 percent.

The smoking article 10 further comprises a ventilation zone 26 at a location along the first filter segment 20. In more detail, the ventilation zone 26 comprises a row of perforations extending through the first filter segment 20. The row of perforations is located 10 mm upstream of the downstream end of the first filter segment. A row of perforations also extend through the band of combining plug wrap 23 and through the band of tipping paper 16. The row of perforations extending through the band of combining plug wrap 23 and through the band of tipping paper 16 are substantially aligned with those extending through the first filter segment 20.

Figure 3:
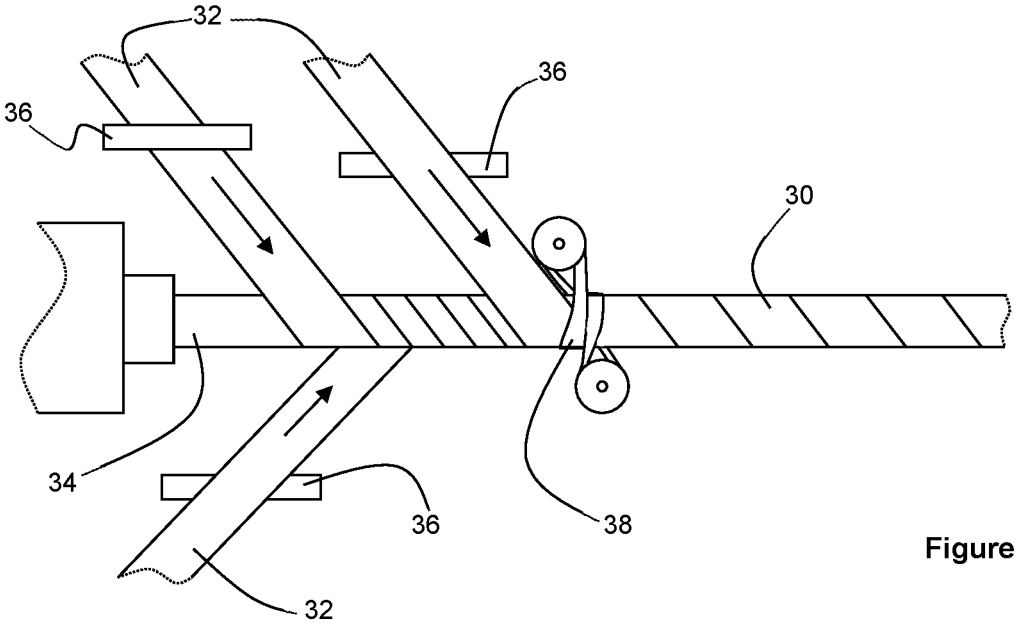
FIG. 3 shows an exemplary method of forming a tubular member for forming hollow tube segments in accordance with the present invention.

FIG. 3 shows an exemplary method of forming a hollow tube member 30 which can be cut to form a plurality of hollow tube segments for use in forming smoking articles in accordance with the present invention. A plurality of continuous paper plies 32 are spirally wound around a cylindrical mandrel 34 in a staggered, overlapping arrangement. A suitable adhesive may be applied to one or more of the plies 32 using an adhesive bath 36 prior to winding each ply around the mandrel 34. The plies 32 are driven by a rubber belt 38 so that the formed tubular member 30 rotates around the mandrel 34 until it is cut into desired lengths further downstream.

The invention claimed is:

1. A smoking article comprising:

a tobacco rod; and a filter connected to the tobacco rod, the filter comprising:

a hollow mouth end portion formed by a hollow tube segment that is disposed at a mouth end of the filter; and a filtration portion upstream of the hollow mouth end portion, the filtration portion comprising one or more filter segments;

wherein the hollow mouth end portion defines a cavity at the mouth end of the filter providing an unrestricted flow channel that extends from the downstream end of the filtration portion to the mouth end of the filter, wherein the length of the hollow tube segment is less than about 30 mm and wherein the smoking article comprises a ventilation zone comprising at least one circumferential row of perforations provided at a location at least about 2 mm upstream from the downstream end of the filtration portion.

2. The smoking article according to claim 1, wherein the length of the hollow tube segment is less than about 50 percent of the overall filter length.

3. The smoking article according to claim 1, wherein the length of the hollow tube segment is at least about 8 mm.

4. The smoking article according to claim 1, wherein the at least one circumferential row of perforations is located at least about 5 mm upstream from the downstream end of the filtration portion.

5. The smoking article according to claim 1, wherein the wall thickness of the hollow tube segment is at least about 100 micrometres, preferably at least about 200 micrometres.

6. The smoking article according to claim 1, wherein the hollow tube segment is formed from a plurality of overlapping paper layers.

7. The smoking article according to claim 1, wherein the hollow tube segment is formed from an annular shaped segment of filtration material.

8. The smoking article according to claim 7, wherein the annular shaped segment of filtration material comprises fibres of between approximately 1.5 denier per filament (dpf) and approximately 8 dpf.

9. The smoking article according to claim 1, wherein the difference between the ovality of the hollow tube segment after 50 percent deformation of the filter and the ovality of the hollow tube segment prior to deformation of the filter is less than 25 percent.

10. The smoking article according to claim 1, wherein the one or more filter segments of the filtration portion comprise a first filter segment, and wherein the length of the first filter segment is at least 8 mm.

11. The smoking article according to claim 10, wherein the length of the hollow tube segment is within 2 mm of the length of the first filter segment.

12. The smoking article according to claim 10, wherein the length of the hollow tube segment is less than the length of the first filter segment.

13. The smoking article according to claim 1, wherein the at least one circumferential row of perforations is provided at least 18 mm from the mouth end of the filter.

14. The smoking article according to claim 1, wherein the hollow tube segment is formed from an annular shaped segment of cellulose acetate.

15. The smoking article according to claim 1, wherein the ovality of the hollow tube segment after a 50 percent deformation of the filter performed after the smoking article has been subjected to a smoking test is less than 35 percent.

16. The smoking article according to claim 1, wherein the ovality of the hollow tube segment after a 67 percent deformation of the filter performed after the smoking article has been subjected to a smoking test is less than 45 percent.

17. The smoking article according to claim 1, wherein the ovality of the hollow tube segment after 67 percent deformation of the filter is less than 35 percent.

18. The smoking article according to claim 1, wherein the hollow tube segment is circumscribed by a wrapper in order to maintain axial alignment of the hollow tube segment with the filtration portion.

19. The smoking article according to claim 1, wherein the hollow tube segment and one or more filter segment or segments of the filtration portion are circumscribed by a band of combining plug wrap.

20. The smoking article according to claim 1, wherein a band of tipping paper circumscribes the filter and a portion of the tobacco rod to join the filter and the tobacco rod together.

* * * * *